United States Patent [19]

Hodge

[11] 4,114,800

[45] Sep. 19, 1978

[54] NEWSPAPER SUPPORT FOR A NEWSPAPER DELIVERY TUBE

[76] Inventor: Joel W. Hodge, 208 Riverview Ct., Elizabethton, Tenn. 37643

[21] Appl. No.: 831,178

[22] Filed: Sep. 7, 1977

[51] Int. Cl.[2] ..... B65D 91/00

[52] U.S. Cl. ..... 232/1 C; 232/17

[58] Field of Search ..... 232/1 C, 17, 33, 34, 232/38

[56] References Cited

U.S. PATENT DOCUMENTS

| | | | |
|---|---|---|---|
| 1,200,915 | 10/1916 | Banta | 232/33 |
| 1,848,995 | 3/1932 | Coleman | 232/33 |
| 2,431,171 | 11/1947 | Gauloin | 232/17 |
| 3,042,293 | 7/1962 | Miller | 232/1 C |
| 3,275,228 | 9/1966 | Golla | 232/1 C |
| 4,026,461 | 5/1977 | Hodge | 232/17 |

*Primary Examiner*—Roy D. Frazier
*Assistant Examiner*—Peter A. Aschenbrenner
*Attorney, Agent, or Firm*—R. Laddie Taylor

[57] ABSTRACT

A newspaper support for a newspaper delivery tube is provided which comprises a wedge surface having a length greater than one-half the length of the tube. The support may be molded directly in the bottom of the tube, or may be provided with a clamp for insertion into an existing delivery tube.

3 Claims, 14 Drawing Figures

NEWSPAPER SUPPORT FOR A NEWSPAPER DELIVERY TUBE

BACKGROUND OF THE INVENTION

1. Field of the Invention

Newspaper delivery in rural and suburban areas by motor vehicle or bicycle is common in many parts of the country. In these areas a receptacle is provided beside the street or highway for the receipt of the paper. This receptacle generally consists of a metal or plastic tube of one piece construction open at one end and closed at the other. The tube is usually slightly tapered away from the open end.

Such receptacles often become wet inside and at the bottom of the tube due to rain beating on the open end thereof, or merely by the water entering interiorly through longitudinal bottom openings customarily provided, or through openings through which fasteners are projected.

2. Description of the Prior Art

Ridges are sometimes molded into the bottom of the tube to raise the paper therefrom and to provide additional longitudinal stability and strength. Such a modification in structure is provided for in U.S. Pat. No. 3,134,538, and U.S. Pat. No. 3,181,782.

These ridges have not been completely successful in keeping a paper dry and others have invented and devised methods and devices to compartmentalize the tube to keep the paper at or near the top of the tube. Miller, in U.S. Pat. No. 3,042,293, has provided a spring clip which holds the paper between the clip and the inside top of the tube. The present applicant, in U.S. Pat. No. 4,002,291, has provided an insert bracket, which holds the paper between the clip and the inside top of the tube. These particular devices are quite effective in keeping the paper dry, but suffer from the disadvantage that the delivery person must force the paper into the tube instead of flipping the paper into the tube during inclement weather, thus slowing delivery and limiting the size of the route. A preferable device would allow a delivery person to use the tube in a normal unconstricted manner.

Applicant's U.S. patent application Ser. No. 700,918, filed June 29, 1976, now U.S. Pat. No. 4,026,461, the teachings of which are herein incorporated as reference under the authority of Section 608.01 (p) of the *Manual Of Patent Examining Procedure,* discloses a newspaper support insert for use in a newspaper delivery tube comprising a horizontally corrugated wedge of about one-half the length of the delivery tube, the support possessing a reversely turned forward clamp to engage the lower front edge of the open end of the tube and at least one drainage hole in each trough of the corrugated surface. The purpose of this insert is to support a newspaper above the bottom of the delivery tube to prevent the newspaper from becoming wet from water which has been retained in the bottom thereof.

Applicant provides, in his U.S. patent application Ser. No. 804,768, filed June 8, 1977, a newspaper support for a newspaper delivery tube comprising a single wedge surface having a length of no more than one-half the length of the tube that is located at a selected position along the bottom of the tube.

Further, applicant discloses, in his U.S. patent application Ser. No. 824,095, filed Aug. 12, 1977, a newspaper support for a newspaper delivery tube comprising a corrugated surface having a length greater than one-half the length of the tube, at least one drainage hole being provided at each trough of the corrugated surface.

Additionally, applicant provides, in his U.S. patent application, Ser. No. 798,152, filed May 18, 1977, a newspaper delivery tube containing a false bottom comprising a corrugated surface extending about one-half the length of the tube, a first support section to raise the false bottom from the bottom of the tube, and a second smooth support section extending downwardly toward the rear of the tube.

Applicant's newspaper support devices described in his U.S. patent and patent applications referred to above, which applications are also incorporated herein as reference, are generally adequate for preventing a newspaper placed in a tube containing these devices from becoming wet from water lying on the bottom of the tube. However, the design of these devices has the shortcoming that the newspaper may slide out the front of the tube if it is carelessly inserted therein by the newspaper carrier.

SUMMARY OF THE INVENTION

It is an object of this invention to provide a simple device which will protect a newspaper from water lying on the bottom of a newspaper delivery tube.

It is another object of this invention to provide a newspaper support for a newspaper delivery tube which will allow the delivery tube to be used in a normal manner as unconstricted at the open end.

It is a further object of this invention to provide a device that can be installed in delivery tubes already in use as well as in new tubes during manufacture, sale, or installation.

This invention provides a newspaper support for a newspaper delivery tube of one piece, elongated, hollow body construction open at one end and closed at the other, which support comprises a surface having generally the shape of an inverted V and having a length greater than one-half the length of the tube, the upper edge of the inverted V portion of the surface being no more than about one-half the height of the tube and being positioned from the open end of the delivery tube a distance of no more than one-half the delivery tube's length, the front edge of the surface of the support being positioned from the open end of the delivery tube a distance of no more than one-quarter of the delivery tube's length. The support structure may be provided in the delivery tube by stamping or molding during manufacture, or it may be attached to the tube by a clip formed from a reverse turn of the front edge of the support structure. The support preferably contains at least one corrugation or a V-shaped trough for improved water drainage and a tab for pay envelopes or the like. The width of the newspaper support is preferably at least equal to one-half the width of the tube.

In the preferred embodiment of the invention, the newspaper support is of a length and width to fit snugly into the newspaper delivery tube.

BRIEF DESCRIPTION OF THE DRAWINGS

The invention will become more apparent when described in conjunction with the drawings, in which like reference numerals designate like parts in the different views, and wherein.

DESCRIPTION OF THE PREFERRED EMBODIMENTS

Figure 1:
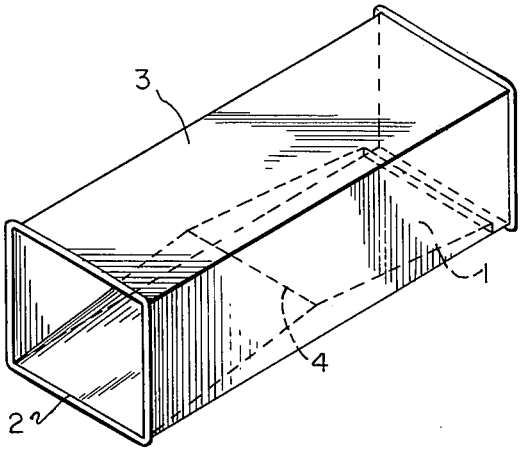
FIG. 1 is a perspective view of one embodiment of the newspaper support of this invention in a newspaper delivery tube.
Figure 2:
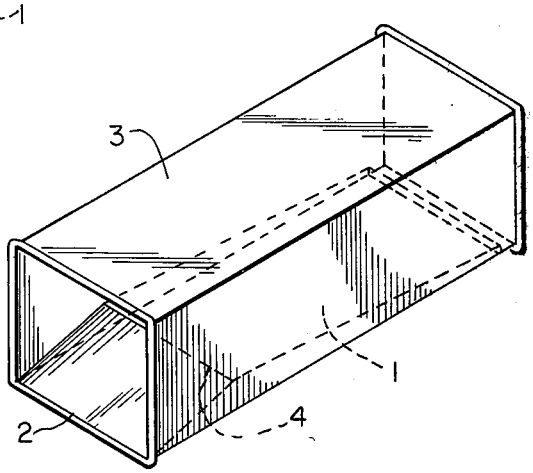
FIG. 2 is a perspective view of an alternate configuration of the embodiment of FIG. 1.

Referring now to FIG. 1, a newspaper support 1 is provided with the front edge 2 thereof lying directly at the open end of a newspaper delivery tube 3 of one piece, elongated, hollow body construction open at one end and closed at the other, the support 1 comprising a surface having generally the shape of an inverted V and having a length greater than one-half the length of the tube 3, the upper edge 4 of the inverted V portion of the surface being positioned essentially in the middle of the delivery tube 3 and being no more than about one-half the height of the tube 3. FIG. 2 shows an alternate configuration of the newspaper support 1 of FIG. 1, wherein the upper edge 4 of the inverted V portion of the surface is positioned from the front of the open end of the tube 3 a distance of less than one-half the delivery tube's length.

Figure 3:
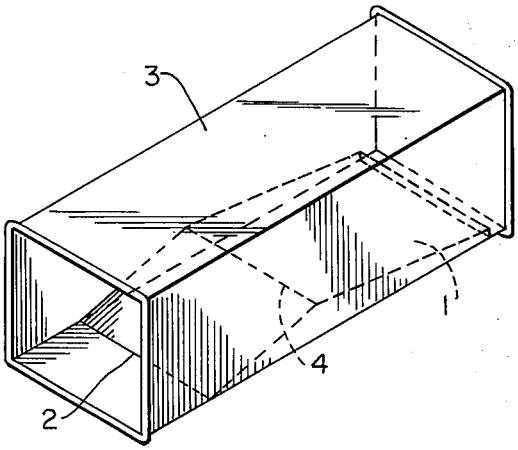
FIG. 3 is a perspective view of a second embodiment of the newspaper support of this invention in a newspaper delivery tube.
Figure 4:
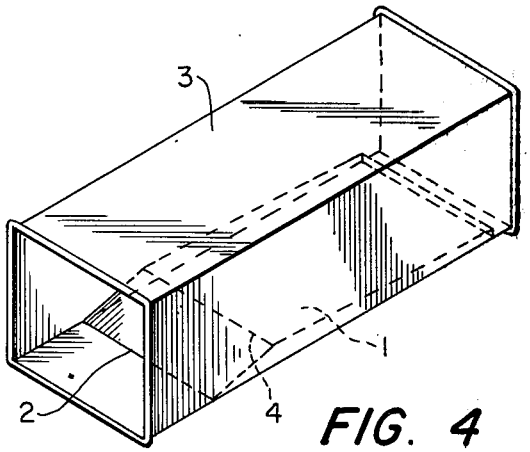
FIG. 4 is a perspective view of an alternate configuration of the embodiment of FIG. 3.

FIG. 3 and FIG. 4 illustrate a second embodiment of the invention as shown and described above in FIG. 1 and FIG. 2 respectively, wherein the front edge 2 of the surface of the newspaper support 1 is positioned from the open end of the delivery tube 3 a distance of no more than one-quarter of the delivery tube's length.

Figure 5:
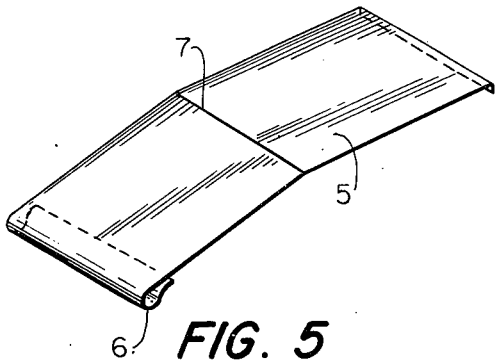
FIG. 5 is a perspective view of a third embodiment of the newspaper support of this invention provided as an insertable structure.
Figure 6:
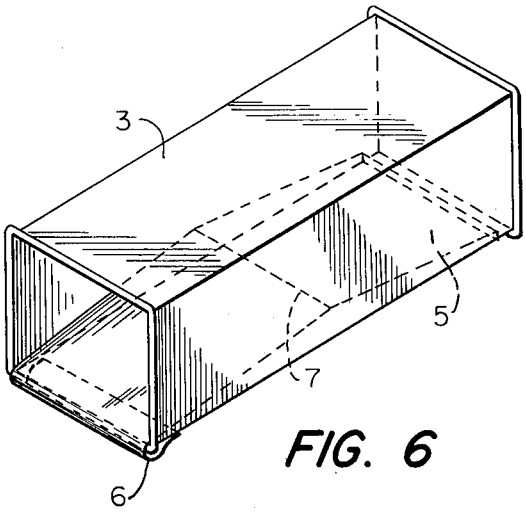
FIG. 6 is a perspective view of the newspaper support of FIG. 5 within a newspaper delivery tube.
Figure 7:
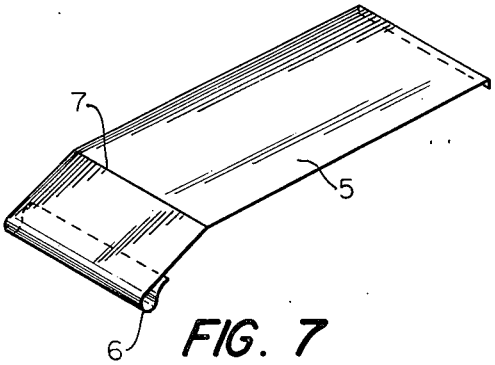
FIG. 7 is a perspective view of an alternate configuration of the embodiment of FIG. 5.
Figure 8:
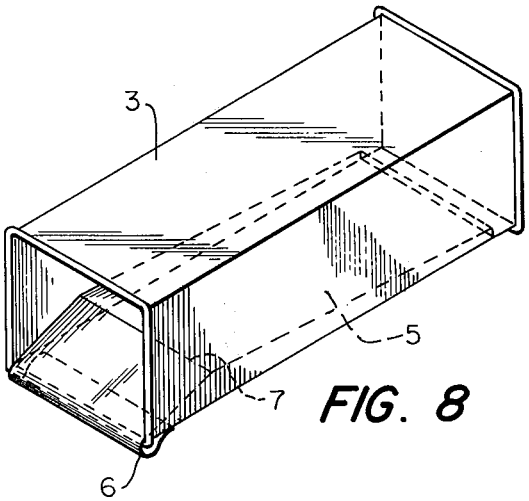
FIG. 8 is a perspective view of the newspaper support of FIG. 7 within a newspaper delivery tube.

Referring now to FIG. 5 and FIG. 6, a newspaper support 5 is illustrated alone and positioned in the newspaper delivery tube 3 previously described, the support 5 comprising a surface having generally the shape of an inverted V and having a length greater than one-half the length of the tube 3 and having a reversely turned forward clamp means 6 to engage the lower surface of the open end of the tube 3, the upper edge 7 of the inverted V portion of the surface being positioned essentially in the middle of the delivery tube 3 and being one-half the height of the tube 3. FIG. 7 and FIG. 8 show an alternate configuration of the newspaper support 5 of FIG. 5 and FIG. 6, wherein the upper edge 7 of the inverted V portion of the surface is positioned from the open end of the delivery tube 3 a distance of less than one-half the delivery tube's length.

Figure 9:
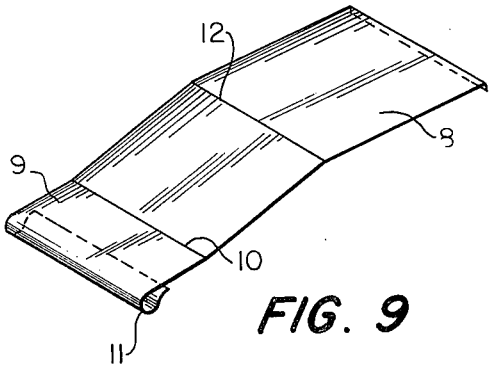
FIG. 9 is a perspective view of a fourth embodiment of the newspaper support of this invention provided as an insertable structure.
Figure 10:
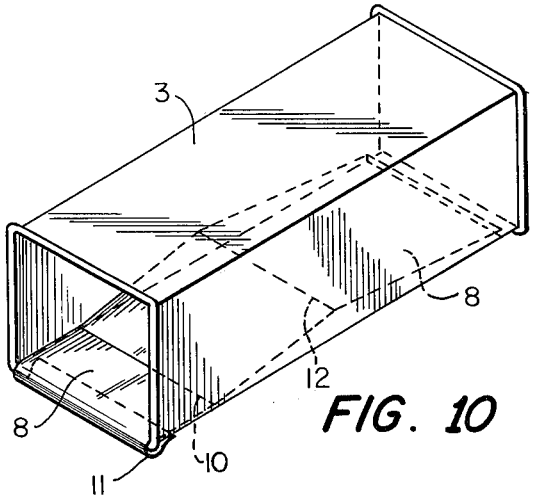
FIG. 10 is a perspective view of the newspaper support of FIG. 9 within a newspaper delivery tube.
Figure 11:
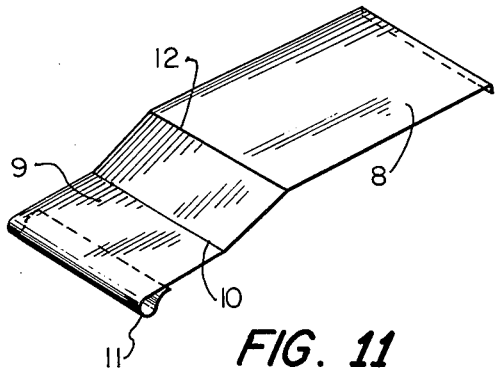
FIG. 11 is a perspective view of an alternate configuration of the embodiment of FIG. 9.
Figure 12:
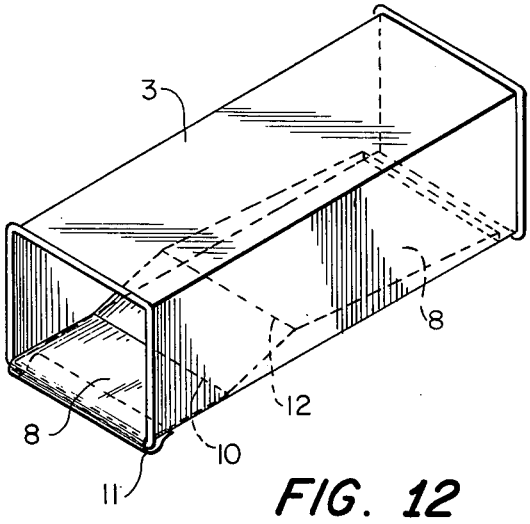
FIG. 12 is a perspective view of the newspaper support of FIG. 11 within a newspaper delivery tube.

FIG. 9 and FIG. 10 show another embodiment of the newspaper support for the newspaper delivery tube 3 described above, the support 8 comprising a surface having generally the shape of an inverted V and having a length greater than one-half the length of the tube 3 and a flat surface 9 extending from the front edge 10 of the surface of the support 8 having a generally turned forward clamp means 11 to engage the lower surface of the open end of the tube 3, the upper edge 12 of the inverted V portion of the surface being positioned essentially in the middle of the delivery tube 3 and being no more than about one-half the height of the tube 3. FIG. 11 and FIG. 12 show an alternate configuration of the newspaper support 8 of FIG. 9 and FIG. 10, wherein the upper edge 12 of the inverted V portion of the surface from the open end of the delivery tube 3 a distance less than one-half the delivery tube's overall length.

Figure 13:
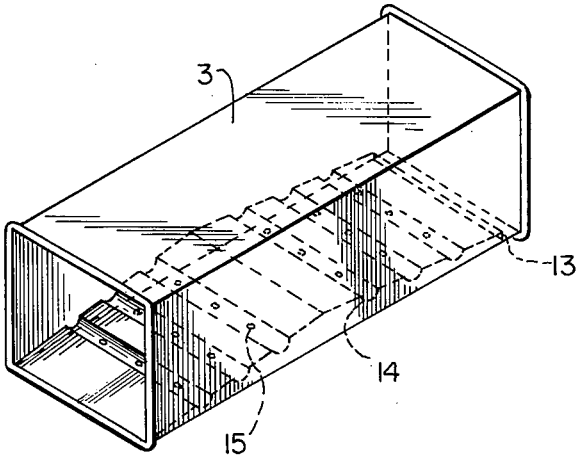
FIGS. 13 and 14 are perspective views of preferred embodiments of the newspaper support of this invention in newspaper delivery tubes.
Figure 14:
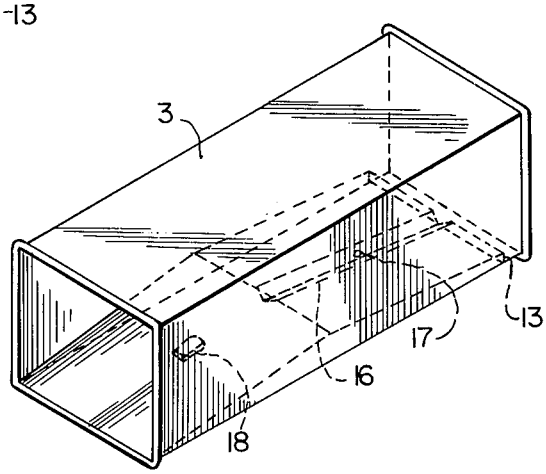

Referring finally to FIG. 13 and FIG. 14, the surface of the newspaper support of the invention, the various embodiments of which are described in detail above, preferably terminates at its upper end with a support leg 13 which extends to the surface of the inside base of the tube, and at least one downwardly turned corrugation having at least one drainage hole therein is preferably provided in the surface of the support as additional means for draining water from the surface thereof. The embodiment of the invention illustrated in FIG. 13 shows the newspaper support having several downwardly turned corrugations 14 in its inverted V-shaped surface, the corrugations containing drainage holes 15 therein. In FIG. 14, a V-shaped trough 16, preferably containing at least one hole 17, is provided along the longitudinal center of at least one side of the "V" of the inverted V-shaped surface of the newspaper support to provide additional means for draining water from the surface thereof.

Additionally, a portion of the surface of the newspaper support may be formed into a tab 18 curved into a spaced relationship above the surface to act as a clip holder for small flat objects such as payment envelopes placed between the tab and the surface.

While the invention has been described in detail with reference to the drawings and various embodiments thereof, it will be apparent to one skilled in the art that various changes and modifications can be made therein without departing from the scope and spirit thereof, and, therefore, the invention is not intended to be limited except as indicated in the appended claims.

I claim:

1. A newspaper support for a newspaper delivery tube of one piece, elongated, hollow body construction open at one end and closed at the other, which support comprises a surface having generally the shape of an inverted V and having a length greater than one-half the length of the tube, the upper edge of the inverted V portion of the surface being no more than about one-half the height of the tube and positioned from the open end of the tube a distance of no more than one-half the delivery tube's length, the front edge of the surface of the support being positioned from the open end of the delivery tube a distance of no more than one-quarter of the delivery tube's length, wherein a V-shaped trough is provided along the longitudinal center of at least one side of the "V" of the inverted V-shaped surface of the support.

2. A newspaper support for a newspaper delivery tube of one piece, elongated, hollow body construction open at one end and closed at the other, which support comprises a surface having generally the shape of an inverted V and having a length greater than one-half the length of the tube and having a reversely turned forward clamp means to engage the lower surface of the open end of the tube, the upper edge of the inverted V portion of the surface being no more than about one-half the height of the tube and positioned from the open end of the delivery tube a distance of no more than one-half the delivery tube's length, wherein a V-shaped trough is provided along the longitudinal center of at least one side of the "V" of the inverted V-shaped surface of the support.

3. A newspaper support for a newspaper delivery tube of one piece, elongated, hollow body construction open at one end and closed at the other, which support comprises a surface having generally the shape of an inverted V and having a length greater than one-half the length of the tube and a flat surface extending from the front edge of the surface of the support having a reversely turned forward clamp means to engage the lower surface of the open end of the tube, the upper edge of the inverted V portion of the surface being no more than about one-half the height of the tube and positioned from the open end of the tube a distance of no more than one-half the delivery tube's length, the flat surface extending the front edge of the surface of the support from the open end of the delivery tube a distance of no more than about one-quarter of the delivery tube's overall length, wherein a V-shaped trough is provided along the longitudinal center of at least one side of the "V" of the inverted V-shaped surface of the support.

* * * * *